US007806722B2

(12) United States Patent
Yu et al.

(10) Patent No.: US 7,806,722 B2
(45) Date of Patent: Oct. 5, 2010

(54) CABLE ASSEMBLY WITH GROUNDING PIECES

(75) Inventors: Ya-Fei Yu, Shenzhen (CN); Xian-Kui Shi, Shenzhen (CN); Chung-Yen Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/482,483

(22) Filed: Jun. 11, 2009

(65) Prior Publication Data

US 2009/0311909 A1 Dec. 17, 2009

(30) Foreign Application Priority Data

Jun. 11, 2008 (CN) ..... 200820301122

(51) Int. Cl.
*H01R 13/60* (2006.01)

(52) U.S. Cl. ..... 439/540.1; 439/79

(58) Field of Classification Search ..... 439/540.1, 439/541.5, 63, 79, 607.23, 607.24, 607.25, 439/607.26, 607.05, 607.17
See application file for complete search history.

(56) References Cited

U.S. PATENT DOCUMENTS 5,643,008 A * 7/1997 Tan et al. ..... 439/541.5
6,095,861 A * 8/2000 Lin et al. ..... 439/607.25
6,099,351 A * 8/2000 Wu ..... 439/607.43
6,227,904 B1 * 5/2001 Wang et al. ..... 439/541.5
6,383,024 B1 * 5/2002 Wang et al. ..... 439/607.23
6,475,034 B1 * 11/2002 Zhang et al. ..... 439/607.4
D482,659 S * 11/2003 Zhang ..... D13/147
6,699,074 B1 3/2004 Wu et al.
6,939,168 B2 * 9/2005 Oleynick et al. ..... 439/541.5
6,997,742 B1 * 2/2006 Tung ..... 439/541.5
7,052,322 B2 * 5/2006 Hu et al. ..... 439/607.25
7,118,414 B2 * 10/2006 Spears et al. ..... 439/540.1
7,303,432 B1 * 12/2007 Chen et al. ..... 439/540.1
7,488,207 B2 * 2/2009 Zheng et al. ..... 439/541.5
7,588,458 B2 * 9/2009 He et al. ..... 439/541.5
7,611,380 B2 * 11/2009 Yuan ..... 439/541.5
2004/0180574 A1 * 9/2004 Liu ..... 439/541.5
2004/0229502 A1 * 11/2004 Hu et al. ..... 439/541.5
2007/0243757 A1 * 10/2007 Wan et al. ..... 439/541.5
2009/0305555 A1 * 12/2009 Wang et al. ..... 439/541.5

FOREIGN PATENT DOCUMENTS

CN 201029177 Y 2/2008

* cited by examiner

*Primary Examiner*—T C Patel
*Assistant Examiner*—Harshad C Patel
(74) *Attorney, Agent, or Firm*—Wei Te Chung; Andrew C. Cheng; Ming Chieh Chang

(57) ABSTRACT

A cable assembly comprises a housing defining a first cavity, a second cavity and at least one third cavity extending rearwardly from a front surface thereof, each third cavity communicated with the first cavity or the second cavity. At least one first and second electrical connector are respectively received into the first and second cavity, each first and second electrical connector defines a metallic shell thereof. At least one first cable and second cable electrically are respectively connected with the first and second electrical connector. At least one plastic piece assembled with at least one grounding piece is received into each third cavity, the grounding piece contact with the metallic shell of the first or second electrical connector. A shielding member is assembled to the housing and contacted with the grounding piece.

20 Claims, 5 Drawing Sheets

CABLE ASSEMBLY WITH GROUNDING PIECES

FIELD OF THE INVENTION

The present invention relates to cable assembly, particularly to a cable assembly integrating a plurality of electrical connectors together in a compact structure and with good effectiveness of EMI shielding.

DESCRIPTION OF PRIOR ART

Along with the miniaturization and multi-functional development trend of electronic apparatus, the requirements for electrical connectors are on a rapid increase. The electrical connectors are required to not only have an excellent performance of signal transmission, but also have the structure of compact size, simplicity and user-friendly features. Recently, Universal Serial Bus (USB) and audio jack both become a popular connection interface. The USB and audio jack are designed to provide input/output (I/O) ports of an electronic apparatus. With the trend toward miniaturization in electrical apparatus, a variety of compositive connector assemblies integrating a plurality of electrical connectors have been developed.

U.S. Pat. No. 6,193,554 to Wu on Feb. 21, 2001 disclose a stacked USB connector assembly adapted to be mounted on a mother board at an I/O port of an electronic apparatus for mating with complementary USB connectors of a peripheral equipment, i.e. a keyset, a mouse, a Personal Digital Assistant (PDA), or a Digital Camera. U.S. Pat. No. 6,234,834 issued to Tsai on May 22, 2001 further discloses a stacked audio jack connector assembly adapted to be mounted on a mother board at an I/O port of an electronic apparatus for mating with complementary audio plug of a speaker or a computer to provide an audio transmission therebetween. In addition, U.S. Pat. No. 6,699,074 issued to Wu on Mar. 2, 2004 discloses a cable assembly with two USB connectors and two audio jacks arranged side by side on a mother board and serving as an I/O port of an electronic apparatus for mating with complementary USB connectors or audio plugs of a peripheral equipment.

The stacked cable assembly can save the width space of the mother board in a horizontal direction compared to the electrical connectors arranged in a row. However, the stacked cable assembly also has occupied vertical space of the mother board. So, when more and more connectors are terminated and integrated into a cable connector module, the stacked cable assembly or the side by side arranged cable assembly can not fit into an electrical device which become smaller and smaller.

As discussed above, an improved cable assembly overcoming the shortages of existing technology is needed.

SUMMARY OF THE INVENTION

Accordingly, an object of the present invention is to provide a cable assembly integrating a plurality of electrical connectors together in a compact structure and with good effectiveness of EMI shielding.

In order to achieve the above-mentioned objects, a cable assembly comprises a housing defining a first cavity, a second cavity and at least one third cavity extending rearwardly from a front surface thereof, each third cavity communicated with the first cavity or the second cavity. At least one first and second electrical connector respectively are respectively received into the first and second cavity, each first and second electrical connector defines a metallic shell thereof. At least one first cable and second cable electrically are respectively connected with the first and second electrical connector. At least one plastic piece assembled with at least one grounding piece is received into each third cavity, the grounding piece contact with the metallic shell of the first or second electrical connector. A shielding member is assembled to the housing and contacted with the grounding piece.

Other objects, features and advantages of the invention will be apparent from the following detailed description taken in connection with the accompanying drawings.

DETAILED DESCRIPTION OF PREFERRED EMBODIMENTS

Figure 1:
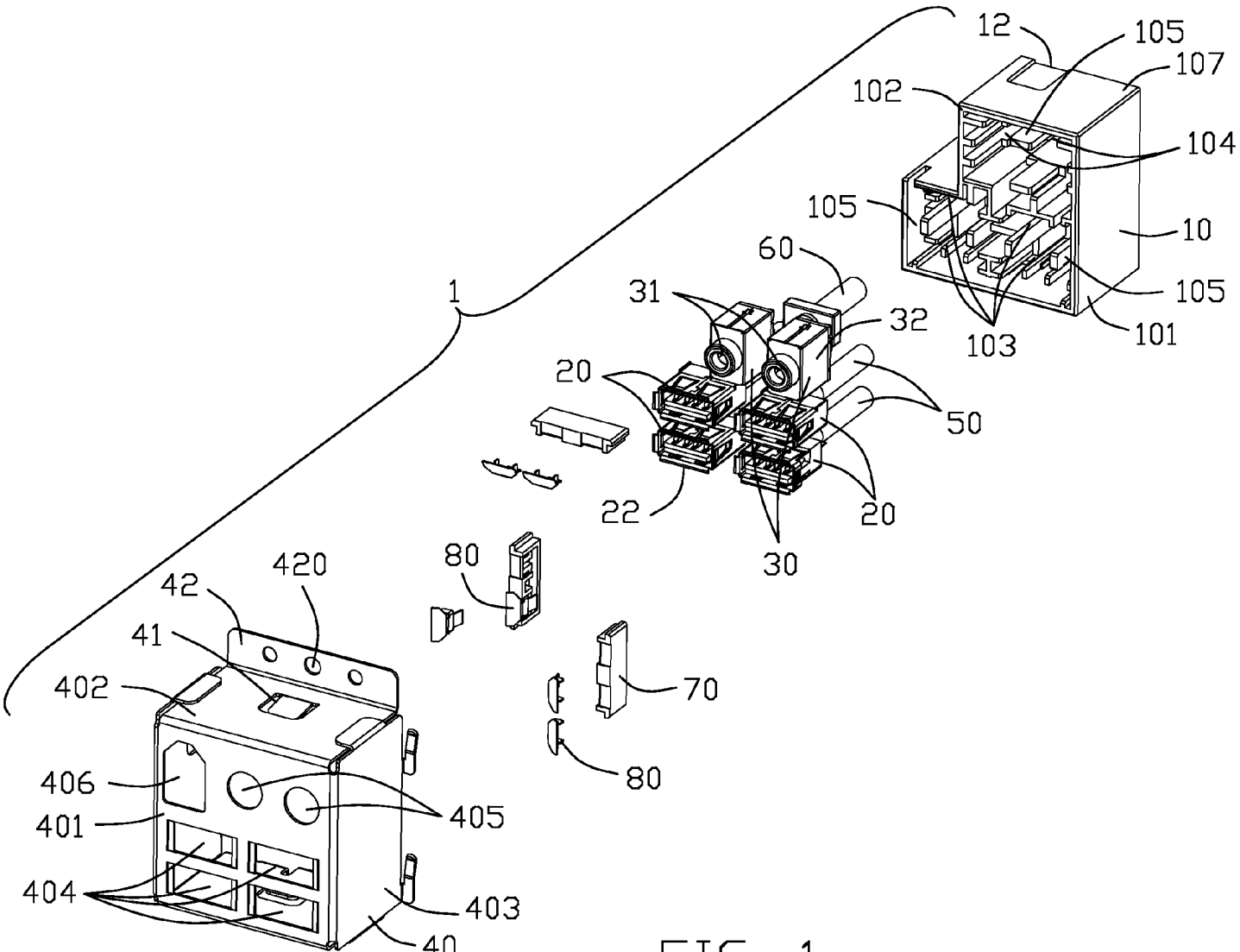
FIG. 1 is an exploded, perspective view of a cable assembly in accordance with the present invention.

Reference will now be made to the drawing figures to describe the present invention in detail.

Figure 5:
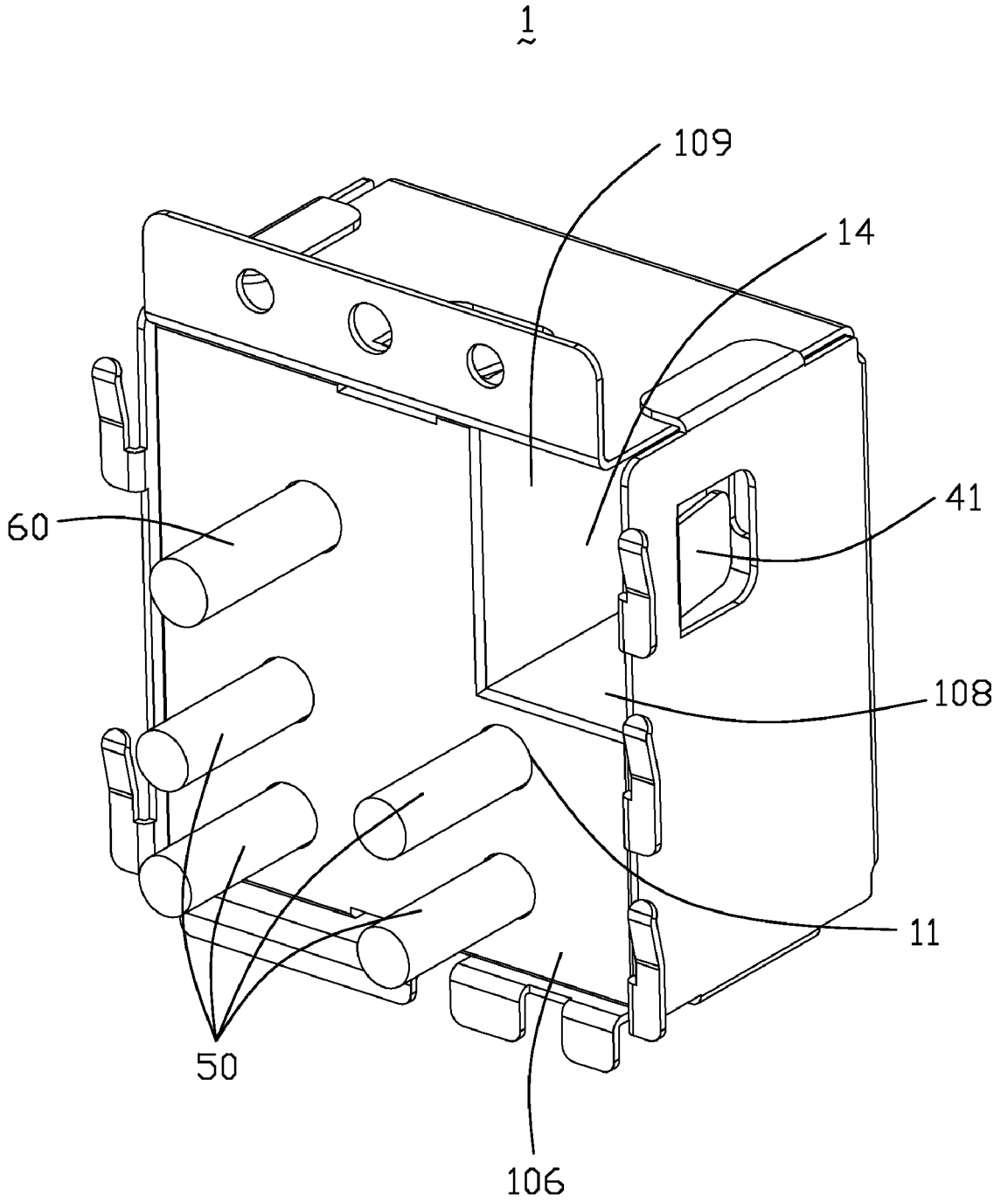
FIG. 5 is similar to FIG. 4, but viewed from another aspect.

Referring to FIGS. 1 and 5, a cable assembly in accordance with the present invention, generally designated 1, is adapted for mating with a plurality of complementary connectors (not shown). The cable assembly 1 includes an insulative housing 10, four first electrical connectors 20, a pair of second electrical connectors 30, a shielding member 40, four first cables 50, a second cable 60, three plastic pieces 70 and six grounding pieces 80. In the embodiment shown, the first electrical connectors 20 are typical standard Universal Serial Bus (USB) connectors and the second electrical connectors 30 are audio jack connectors. However, in alternative embodiments, the electrical connectors could be provided with any suitable types connectors.

Figure 3:
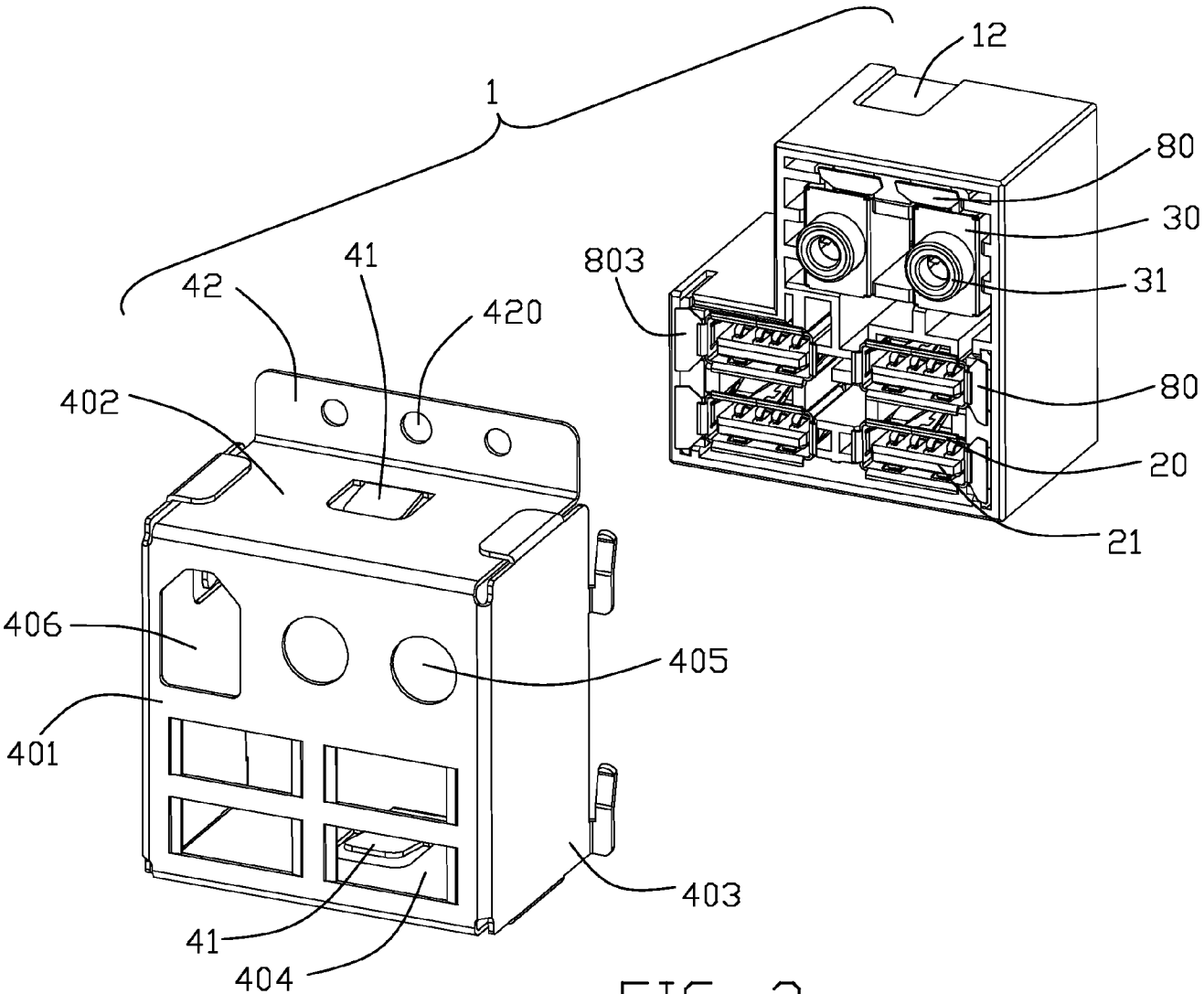
FIG. 3 is a partial assembled, perspective view of the cable assembly of FIG. 1.

Referring to FIG. 1 in conjunction with FIGS. 3 and 5, the insulative housing 10 has a generally L-shaped base portion 101. The base portion 101 has a front surface 102 and a rear surface 106 opposite to the front surface 102. The base portion 101 defines four first cavities 103 communicating with each other for respectively receiving the first electrical connectors 20 therein, a pair of second cavities 104 communicated with the first cavities 103 for respectively receiving the second electrical connectors 30 therein, and three third cavities 105 communicated with the first cavities 103 or second cavities 104 for receiving three plastic pieces 70. Four first cavities 103 are arranged in a matrix form and disposed in a lower section of the base portion 101. A pair of second cavities 104 are arranged side by side and disposed in an upper section of the base portion 101. The pair of second cavities 104 are also in above of the four first cavities 103. The third cavities 105 are formed around the first or second cavities 103, 104. A plurality of passageways 11 is defined in the base 101 from the rear surface 106 recessing inwardly and respectively communicates with the first cavity 103 and the second cavity 104. The passageways 11 are provided for receiving the first cables 50 and the second cable 60. At least one recess 12 is respectively defined on a top surface 107 or bottom surface (not figured) of the insulative housing 10. The base portion 101 can be also designed to a rectangular shape.

Also referring to FIG. 1, the first electrical connectors 20 are two pair of typical USB connectors arranged in a stacked arrangement. Each pair of USB connectors are arranged side by side. The structure of the USB connector is well known to persons skilled in the art, detailed description thereof is omitted here. Four first cables 50 are respectively connected with the four first electrical connectors 20. Each first electrical connector 20 has a mating port 21 at a front portion thereof.

The second electrical connectors 30 are a pair of audio jack connectors arranged side by side. The second electrical connector 30 has a same structure as an ordinary audio jack connector and the detailed description thereof is omitted here. The second cable 60 has a pair of segments at the front end thereof for respectively connected with the second electrical connectors 30. Each second electrical connector 30 has a mating port 31 at a front portion thereof.

Figure 2:
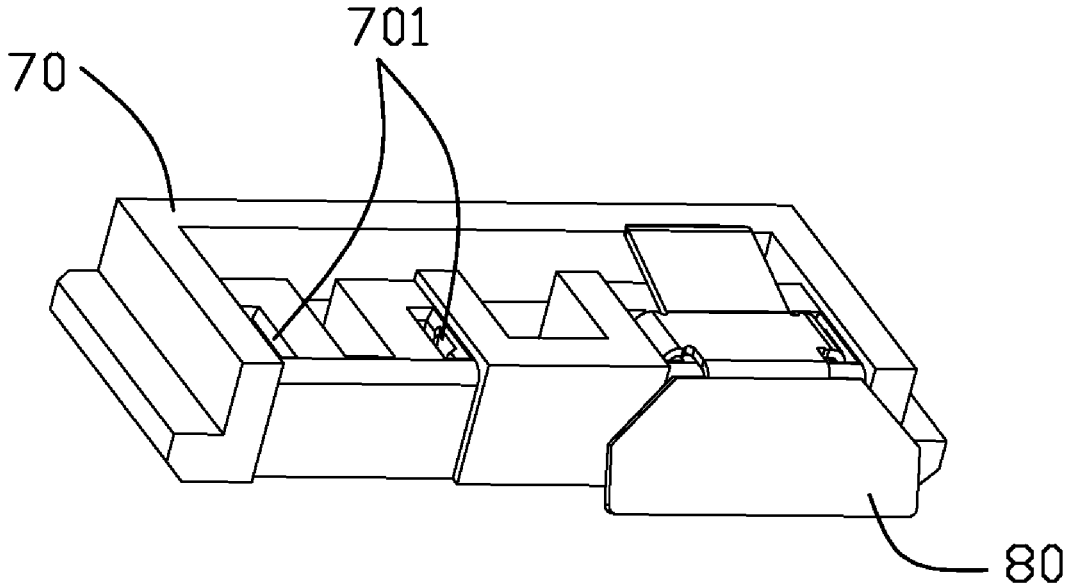
FIG. 2 is a perspective view of a pair of grounding piece and a plastic piece, wherein a grounding piece is assembled to the plastic piece.
Figure 2:
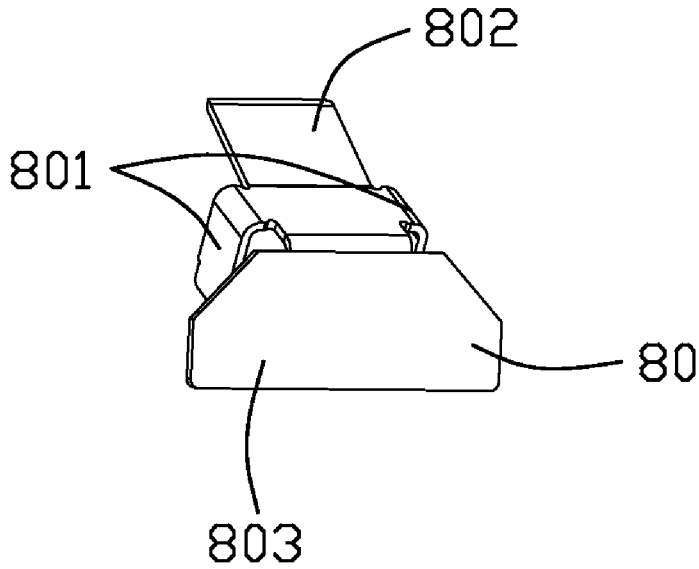

Referring to FIG. 2, each plastic piece 70 is generally a cuboid and defines two pair of positioning slots 701 therein. A pair of grounding pieces 80 can be assembled to the plastic piece 70. Each grounding piece 80 defines a pair of wings 801 at two side thereof, an elastic portion 802 at a rear end thereof and a contacting portion 803 at a front end thereof. The pair of wings 801 of grounding piece 80 can be received into one pair of positioning slots 701 of the plastic piece 70 to make the grounding piece 80 positioned to the plastic piece 70. The plastic piece 70 assembled with the grounding piece 80 can be received into the third cavity 105 of the insulative housing 10 together.

Figure 4:
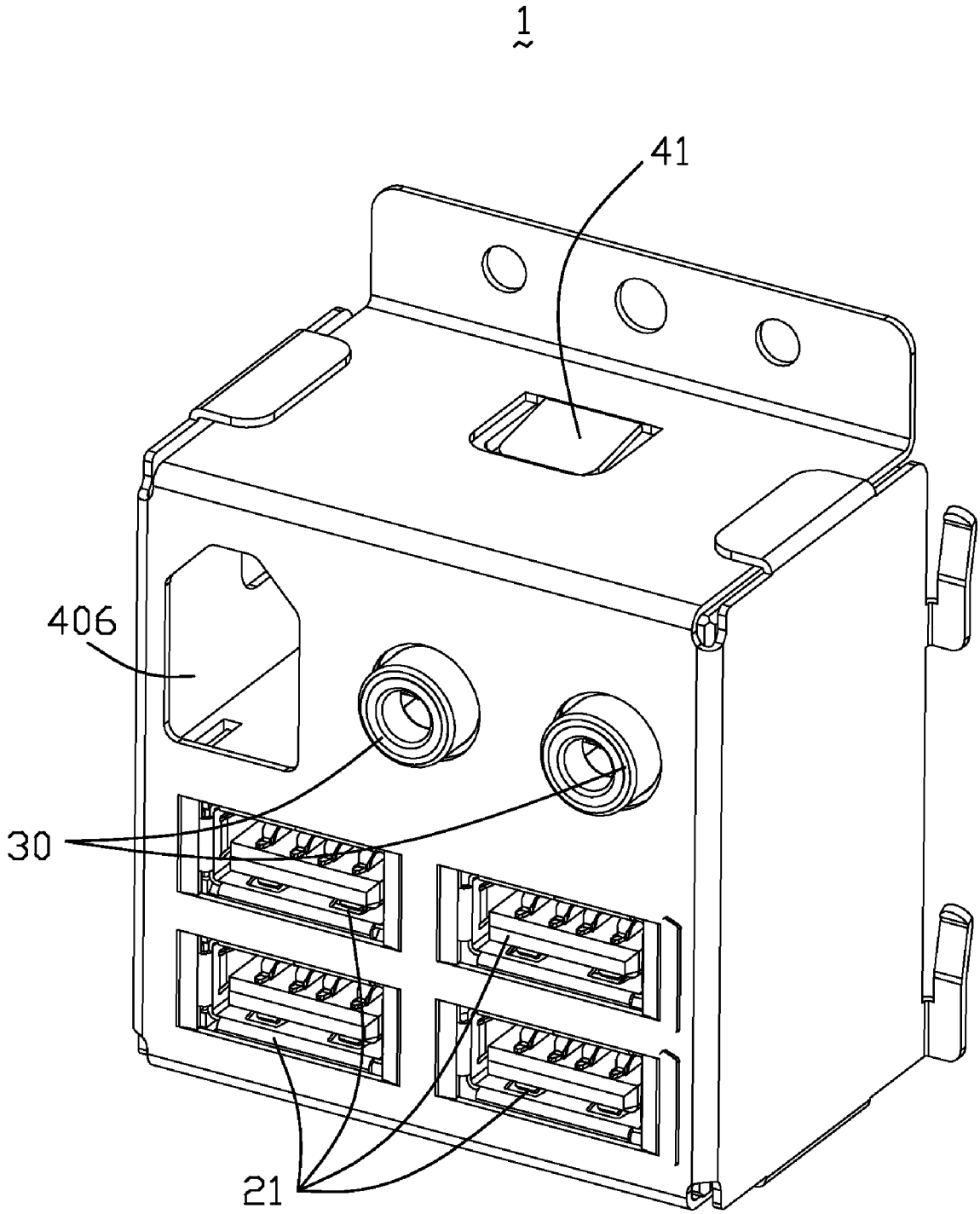
FIG. 4 is a perspective view of a cable assembly in accordance with the present invention.

Referring to FIGS. 1 and 3 in conjunction with FIGS. 4 to 5, the shielding member 40 is generally stamped from a piece of metal or other conductive materials. The shielding member 40 is in a square frame shape for substantially shielding the front surface, a pair of side surfaces and a pair of top and bottom surfaces of the housing 10. The shielding member 40 comprises a front wall 401, a pair of upper and lower walls 402 respectively extending rearward from opposite top and bottom sides of the front wall 401, and a pair of side walls 403 connecting with the pair of upper and lower walls 402. The front wall 401 defines two pairs of first holes 404 aligning with the first cavities 103 and a pair of second holes 405 aligning with the second cavities 104 allowing the mating port 31 of each second electrical connector 30 extending therethrough. The first hole 401 is rectangular and the second hole 402 is circular. Furthermore, a third hole 406 is formed adjacent to the second hole 405 for receiving a IEEE 1394 port. In this embodiment, there is no IEEE 1394 connector is disposed in the third hole 406. Each upper and lower wall 402 is stamped to form at least one engaging tab 41 protruding inwardly which can be received into the corresponding recess 12 of the insulative housing 10. A side wall 403 also defines at least one engaging tab 41 protruding inwardly and adjacent to the third hole 406. The shielding member 40 further defines an engaging plate 42 extending upwardly from a rear end of the upper wall 402. The engaging plate 42 defines a plurality of holes 420 for corresponding screws (not shown) extending therethrough to make the cable assembly 1 fixed on a panel (not shown).

In assembly, as shown in FIG. 1 in conjunction with FIGS. 4 and 5, the first electrical connectors 20 and the second electrical connectors 30 respectively terminated with the first cables 50 and the second cable 60 with the terminals (not labeled) thereof respectively soldered to the corresponding conductors (not shown) of the first cables 50 and the second cables 60 which is well known for persons skilled in the art and the detailed description is omitted here. The first electrical connectors 20 and the second electrical connectors 30 are respectively inserted into the first cavities 103 and the second cavities 104 in a front-to-rear direction with the mating ports 21 and the mating ports 31 thereof exposed away the front surface 102. Correspondingly, the first cables 50 and the second cable 60 extend through the passageway 11 and are beyond the rear surface 106 of base 101 of the insulative housing 10.

Subsequently, as shown in FIGS. 1 to 3, assembling each plastic piece 70 assembled with a pair of grounding pieces 80 to the insulative housing 10. The plastic piece 70 is received into the third cavity 105 of the insulative housing 10. Each elastic portion 802 of the grounding piece 80 contacts with a metallic shell 22 of the first electrical connectors 20 or a metallic shell 32 of the second electrical connectors 30. Each contacting portion 803 of the grounding piece 80 is exposed in an opening of the third cavity 105.

Then, as shown in FIGS. 1 to 4, the shielding member 40 is assembled to the insulative housing 10 with the front wall 40 thereof abutting against the front surface 102 of the base 101. The pair of upper and lower walls 402 of the shielding member 40 shield a top surface 107 and a bottom surface (not figured) of the insulative housing 10, the pair of side walls 403 of the shielding member 40 shield a pair of side surface of the insulative housing 10. A engaging tab 41 of the shielding member 40 is received into the corresponding recess 12 of the insulative housing 10 to make the shielding member 40 engaged with the insulative housing 10. The contacting portion 803 of the grounding piece 80 contact to the front wall 40 of the shielding member 40. Thus, as the grounding piece 80 respectively contacting with the metallic shells 22, 32 of the first and second electrical connectors 20, 30 and the front wall 401 of the shielding member 40, so the metallic shells 22, 32 and the front wall 401 are electrically connected with each other through the grounding piece 80. The grounding area is increased due to the shielding member 40, grounding piece 80 and the metallic shells 22, 32 electrically connected with each other, so the cable assembly 1 has a good effectiveness of EMI shielding when the complementary connectors mated with the first connectors 22 or second connectors 30.

Through the above assembling steps, as shown in FIGS. 4 to 5 in conjunction FIG. 1, the cable assembly 1 is accomplished. In addition, a receiving room 14 is formed by a section of the upper wall and side wall 402, 403 and two surfaces 108, 109 of the insulative housing 10. The receiving room 14 communicates with the third hole 406 of the shielding member 40. At least one engaging tab 41 of the side wall 403 extends inwardly into the receiving room 14. The receiving room 14 is used to receive an electrical connector (not shown), such as IEEE 1394 connector, and a mating port of the electrical connector is exposed in the third hole 40. The electrical connector can be positioned in the receiving room through the engaging tab 41 cooperating with a corresponding recess of the electrical connector.

The first and second electrical connectors 20, 30 of the cable assembly 1 are adapted for mating with a plurality of complementary connectors (not shown). A plurality of electrical connectors (not shown) disposed on the other end of the cable assembly 1 are adapted for mating with corresponding connectors mounted on the mother board of a computer. A corresponding screw (not shown) extends through the hole 420 of the engaging plate 42 of the shielding member 40 for fastening the cable assembly 1 to a panel of the computer. The cable assembly 1 is thus electrically connected with the mother board and adapted for mating with complementary connectors for providing Input/Output transmission.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

a housing defining a first cavity, a second cavity and at least one third cavity extending rearwardly from a front surface thereof, each third cavity communicated with the first cavity or the second cavity;

at least one first and second electrical connector respectively received into the first and second cavity, each first and second electrical connector defining a metallic shell thereof;

at least one first cable and second cable respectively electrically connected with the first and second electrical connector;

at least one plastic piece assembled with a pair of grounding pieces received into each third cavity, each grounding piece contacted with the metallic shell of the first or second electrical connector; and a shielding member assembled to the housing and contacted with the grounding piece.

2. The cable assembly as recited in claim 1, wherein the housing is L-shape, a receiving room is formed between the shielding member and the housing for receiving a third electrical connector, and a hole is formed on the shielding member corresponding to the receiving room.

3. The cable assembly as recited in claim 1, wherein the first cavity is divided into four segments arranged in a matrix form, the second cavity is divided into two segments arranged side by side, and the second cavity is on the top of the first cavity.

4. The cable assembly as recited in claim 3, wherein four first electrical connectors are received into the first cavity, and a pair of second electrical connectors are received into the second cavity.

5. The cable assembly as recited in claim 3, wherein the first cavity communicates with the second cavity.

6. The cable assembly as recited in claim 1, wherein the grounding piece defines a pair of wings at two side thereof, an elastic portion at a rear end thereof and a contacting portion at a front end thereof.

7. The cable assembly as recited in claim 6, wherein the pair of wings of the grounding piece engage with the plastic piece, said elastic portion contact with the metallic shell of the first or second electrical connector and said contacting portion contact with the shielding member.

8. The cable assembly as recited in claim 3, wherein the third cavity is formed around the first or second cavity.

9. The cable assembly as recited in claim 1, wherein the shielding member defines a front wall attached to a front surface of the housing, a pair of upper and lower walls respectively extending rearward from opposite top and bottom sides of the front wall and shielding a pair of top and bottom surfaces of the housing, and a pair of side walls connecting with the pair of upper and lower walls and shielding a pair of side surfaces of the housing.

10. The cable assembly as recited in claim 9, wherein the housing defines at least one recess respectively formed on the top and bottom surface thereof, and each upper and lower wall of the shielding member defines at least one engaging tab received into the recess of the housing.

11. The cable assembly as recited in claim 9, wherein the shielding member defines an engaging plate extending upwardly from a rear end of the upper wall, and the engaging plate defining a plurality of holes for corresponding screws extending therethrough.

12. A cable assembly, comprising:

a housing defining a first cavity, a second cavity above the first cavity and a plurality of third cavities extending rearwardly from a front surface thereof, each third cavity communicated with the first cavity or the second cavity;

a plurality of first electrical connectors received into the first cavity and arranged in a matrix form, a pair of second electrical connectors received into the second cavity arranged side by side, each first and second electrical connector defining a metallic shell thereof;

a plurality of first cables and a pair of second cables electrically connected with the first and second electrical connector;

a plastic piece assembled with a pair of grounding pieces received into each third cavity, the grounding piece contacted with the metallic shell of the first or second electrical connector; and a shielding member shielded to the housing and contacted with the grounding pieces.

13. The cable assembly as recited in claim 12, wherein each grounding piece has a contacting portion exposed in an opening of the third cavity and contacting with a front wall of the shielding member and an elastic portion contacting with the metallic shells of the first and second electrical connectors.

14. The cable assembly as recited in claim 12, wherein four first electrical connectors are received into the first cavity, and the shielding member defines four first holes corresponding to four mating port of the first electrical connectors and a pair of second holes corresponding to a pair of mating port of the second electrical connectors.

15. The cable assembly as recited in claim 12, wherein the housing is L-shape, a receiving room is formed between the shielding member and the housing for receiving a third electrical connector, and a third hole is formed on the shielding member corresponding to the receiving room.

16. The cable assembly as recited in claim 13, wherein each plastic piece defines two pairs of positioning slots, each grounding piece has a pair of wings received into a pair of positioning slots.

17. A cable assembly comprising:

an insulative housing defining a plurality of receiving cavities forwardly communicating with an exterior;

a plurality of electrical connectors received in the corresponding receiving cavities, respectively, each of said connectors defining a mating port and a metallic shell covering a corresponding insulative body thereof;

a metallic shield enclosing said housing and defining a front face with a plurality of openings extending therethrough in alignment with the corresponding receiving cavities in a front-to-back direction perpendicular to said front face to expose the corresponding mating ports, respectively; and a plurality of grounding units defining a first engagement section mechanically and electrically connected to the shell and a second engagement section mechanically and electrically connected to the shield; wherein each of said grounding units is intimately located beside the corresponding housing behind the shield.

18. The cable assembly as claimed in claim 17, wherein each of said grounding units includes a metal grounding piece with said first engagement section and said second engagement section thereof.

19. The cable connector as claimed in claim 18, wherein each of said grounding units is further equipped with a plastic piece associated with the corresponding metallic grounding piece under condition that each of said grounding units are assembled to the housing via said plastic piece.

20. The cable connector as claimed in claim 19, wherein said housing is configured to allow said connectors and said grounding units to be assembled thereto along only a direction parallel to said front-to-back direction.

* * * * *